US005282656A

United States Patent [19]

Fizer

[11] Patent Number: 5,282,656

[45] Date of Patent: Feb. 1, 1994

[54] ORIGINAL DOOR BAR

[76] Inventor: John Fizer, P.O. Box 13772, Fort Wayne, Ind. 46865-3772

[21] Appl. No.: 955,155

[22] Filed: Oct. 1, 1992

[51] Int. Cl.[5] ..... E05C 17/30

[52] U.S. Cl. ..... 292/259 R

[58] Field of Search ..... 292/259, 260, 262, 264, 292/244, 338, 339, DIG. 46

[56] References Cited

U.S. PATENT DOCUMENTS

| | | | |
|---|---|---|---|
| 2,421,275 | 5/1947 | Lopez | 292/259 |
| 3,809,417 | 5/1974 | Craig | 292/259 |
| 4,067,598 | 1/1978 | Mansour | 292/259 R |
| 4,079,973 | 3/1978 | Hollins | 292/264 |
| 4,295,676 | 10/1981 | Smith | 292/DIG. 46 X |
| 4,314,721 | 2/1982 | Clark | 292/DIG. 46 |
| 4,667,992 | 5/1987 | Roden, Jr. | 292/259 R |

OTHER PUBLICATIONS

Spec Sheet (1 page) "PHOENIX DEFENDER SERIES 10–40" (Two FIGS. ).

*Primary Examiner*—Richard E. Moore

[57] ABSTRACT

The security bar system will physically prevent unwanted opening of a hinged door. The system comprises an elongate, rigid adjustable cylinder bar which is adapted to extend on the inside of a door between a pair of mounted brackets. The adjustable bar terminates at its opposite ends in rigid closed ended brackets. The adjustable bar is equipped with a locking pin that is restrained by the left bracket, when bar is in security (horizontal) position. Left bracket is equipped with an indentation that allows for snug fit of locking pin. Bar is restrained by and rotates from horizontal to storage (vertical) position within right bracket, in which self-contained hinge allow for easy rotation. When in storage position bar is held in vertical position by a catcher affixed to molding, above right bracket. Adjustable bar and brackets are coated with a decorative finish so as not to sacrifice the aesthetic integrity of the dwelling.

1 Claim, 2 Drawing Sheets

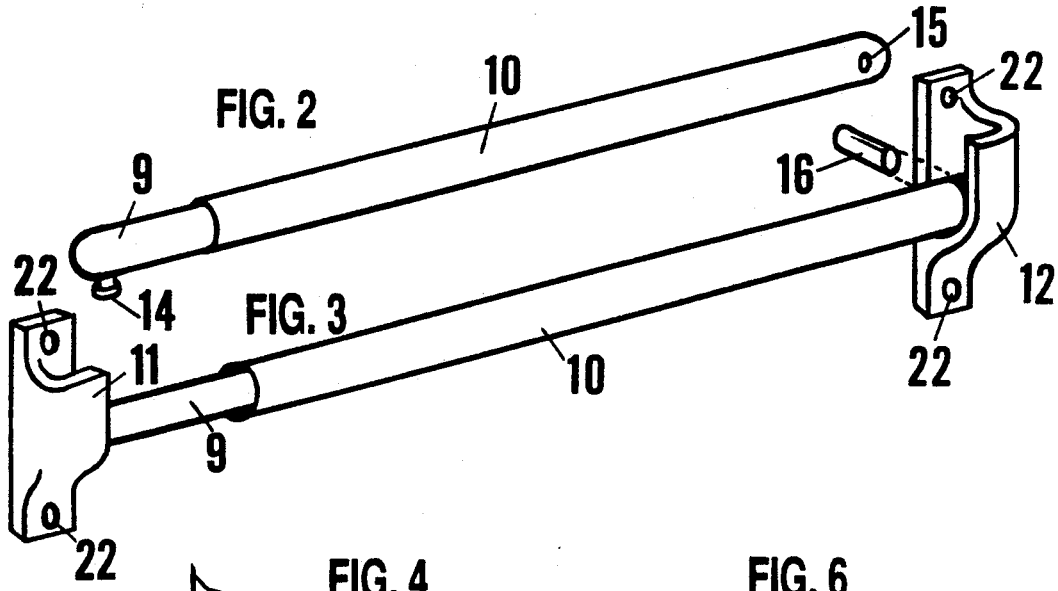
FIG. 2
FIG. 3
15
10
22
9
16
12
22
14
11
10
9
22
22
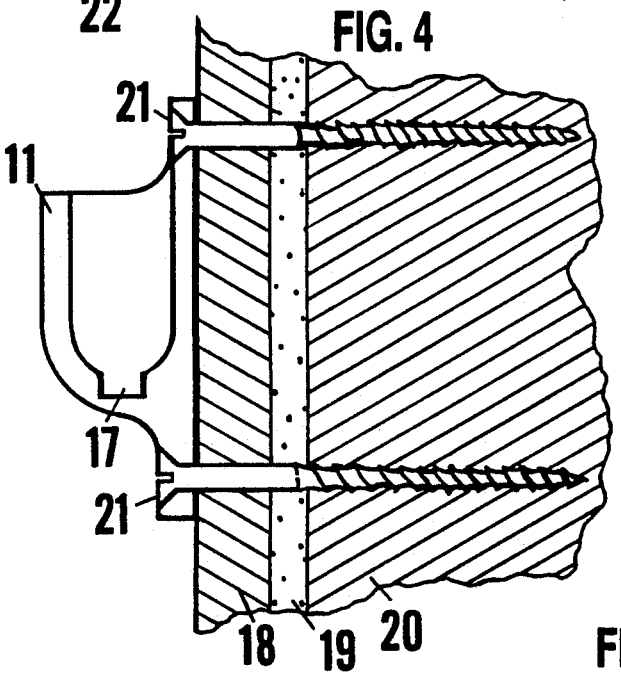
FIG. 4
21
11
17
21
18
19
20
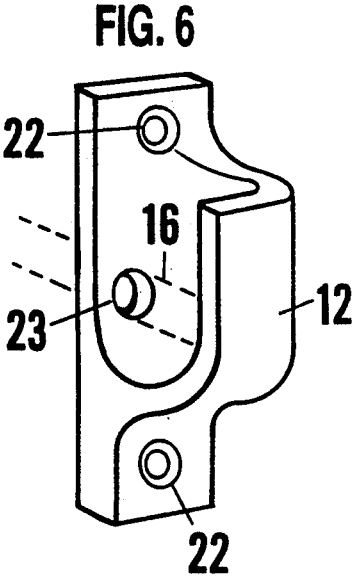
FIG. 6
22
16
23
12
22
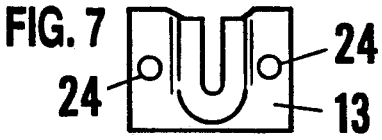
FIG. 7
24
24
13
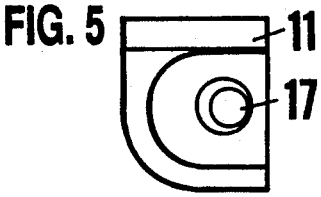
FIG. 5
11
17
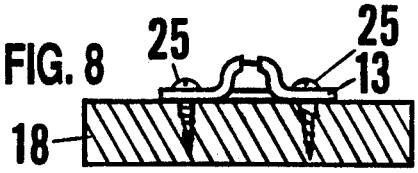
FIG. 8
25
25
13
18

ORIGINAL DOOR BAR

BACKGROUND OF THE INVENTION

The present invention relates generally to hardware and apparatus for securing conventional doors. More particularly, the present door bar is adapted to go from in use (horizontal) to storage position (vertical), with its hinged design, which allows for secure rotation of tubing.

In the prior art a variety of systems have been designed to mount door bars for security reasons. As crime rates in America continue to escalate, the need for a secure, tamper resistant security means is evident. Existing door bar systems suffer from the disadvantage that the removable security bar itself can be lost or misplaced. Since the present invention never leaves the door, it is convenient for use. The decorative finish is designed to complement any interior, whereas current products have an industrial metal finish. Prior art allows for a security system that is one standard size. The advantage of invention is that it is adjustable to fit many size doors. Present invention can be quickly and easily mounted on doors that are hinged on left or right and accommodate the associated hardware.

SUMMARY OF THE INVENTION

The present invention comprises a security bar system for preventing undesirable forcible entry of a door.

The invention consists of an adjustable, cylindrical bar designed to expand and extend across and block a door. The bar terminates at opposite ends in a catcher on one side and a hinged axis on the other side. The hinged design allows the Door Bar to go from securing to storage position in one simple step. When in storage position, invention is held in place by a vertically mounted bracket.

A first mounting catcher is adapted to be vertically oriented with respect to the ground. A circular indentation is designed to lock with the pin mechanism in the bar itself. This locking mechanism ensures high security and a smooth locking mechanism.

The opposite mounting bracket utilizes a hinged design that allows for rotation of the Door Bar from the in use to storage position. The hinged design of this bracket differs from any current security product in that the invention never leaves the door.

Both brackets, located horizontally of each other are designed with a similar appearance, although each has a distinct and separate function. Both brackets are designed to be mounted to the door molding and frame structure to enhance resistance.

Door Bar is held in storage (vertical) position by a mounted catcher, vertical to the rotating hinged bracket. A slot in the vertical storage catcher allows it to hold the pin design on the tubing in vertical storage position.

The high carbon, steel tubing of the adjustable bar provides maximum strength for the system. With its adjustable size range the invention can be utilized for most standard doors. A disadvantage of current such products is that they accommodate only one size door.

The opposite brackets and the outer most tubing are coated with either a brass-like or high gloss white decorative fininsh. The decorative finishes allow the Door Bar to complement any interior. Current home security products have only an industrial metal finish, not complementary to the aesthetics of any interior.

Thus, the object of the present invention is to provide a door bar system for maximizing the security of a dwelling.

A related object is to proved a security enhancement system which may be purchased, as well as installed at a minimal cost.

Yet another object of the present invention is that due to its hinged design it never leaves the door.

Yet another object is that the invention can be easily installed by the consumer without extensive modification to existing structure.

It is an object of the present invention to avoid removal of the bar itself when system not in use.

Yet another object of the present invention is to provide a Door Bar security system of the character described to blend in with or complement the interior of the dwelling to be protected.

A still further object of the present invention is to provide a security system in the character described which can not be dislodged without being maneuvered by the occupent of the protected dwelling.

These and other objects and advantages of the present invention will become apparent in the following descriptive sections.

BRIEF DESCRIPTION OF THE DRAWING

In the following drawings reference numerals have been used to indicate parts various views.

FIG. 1 also demonstrates easy rotation of product from in use to storage position.

FIG. 2 is a perspective view of the adjustable tubing reflecting locking pin on innermost tubing and circular indentation on outside tubing.

FIG. 3 is a perspective of tubing with in the horizontal brackets, indicating invention in the in use position.

FIG. 4 is a cross section view of bracket attached with screws to door molding and frame.

FIG. 5 is a top view of above mentioned bracket.

FIG. 6 is a perspective view of the hinged designed bracket.

FIG. 7 is a perspective view of the vertical catcher to be used when invention is in the storage (vertical) position.

FIG. 8 is a top view of the above mentioned vertical catcher.

DETAILED DESCRIPTION OF INVENTION

Figure 1:
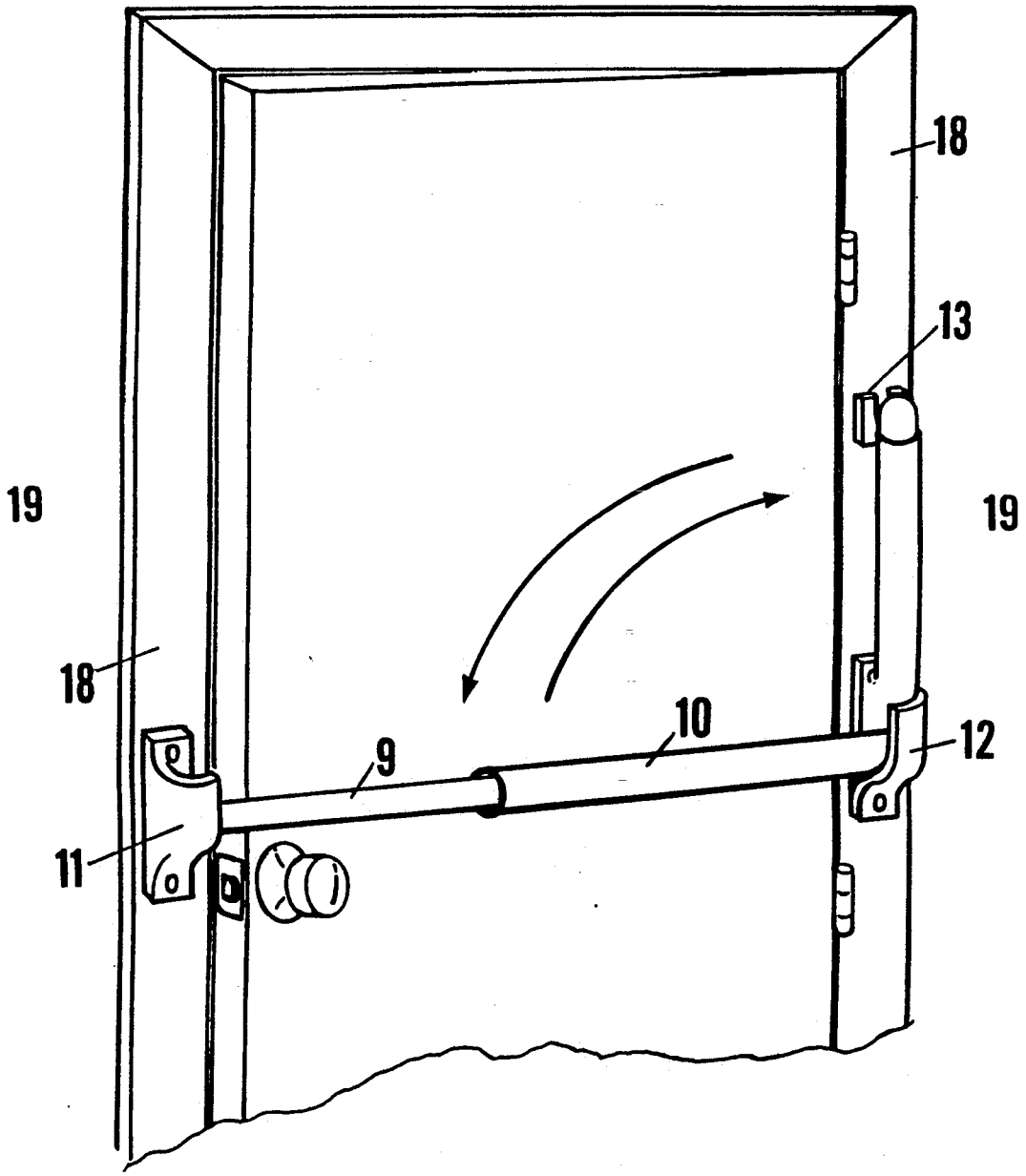
FIG. 1 a perspective view of the invention shown in the invention across a partially closed conventional door mounted within a suitable frame defined within a typical wall.

Turning now to FIG. 1, the Door Bar is shown in the in use and rotating to storage position. Invention is adapted to prevent unauthorized opening of door. The system includes one adjustable bar and three brackets, referred to by the numbers 9, 10, 11, 12, 13. All above components are fuctional with either a left or right hinged door. Bracket 11 is adapted for installation on left side of door. Bracket 11 is the bracket that contains 9 in locked position. Bar 9 expands or contracts from 10 to allow for adjustment of bar length. Bar 10, the outside most bar, along with 9 rotate from horizontal to vertical position The right side bracket 12 allows 9 and 10 to rotate to 13. Bracket 13 is the zinc plated bracket vertical to 12, which holds bar in storage position. A decorative finish is applied to 10, 11, 12.

Bar 9, 10 (FIG. 2 and 3) terminate into rigid, closed ended brackets 11, 12. The locking pin 14 is held secure in circular indentation 17 to prevent forcible dislodging of bar 9 within bracket 11 (FIG. 4 and 5). Door bar 10 has circular hole 15 on rotating end. Rotation occurs by steel tubular pin 16 within bracket 12.

Turning now to FIG. 4, 11 mounted to molding 18, wall 19, and stud 20 with two suitable screws, through orifices 22. Indentation of 17 allows for snug fit of locking pin 14 (FIG. 2) when bar is in horizontal, locked position. FIG. 5 is the top view of 11, detailing indentations 17.

FIG. 6 is a perspective view of bracket 12 detailing circular opening 23 which allows for snug fit of tubular pin 16. Pin 16 intersects 15 (FIG. 3) and 23, housed in 12. Bracket 12 is secured to 18, 19, 20 through orifice 22 with two screws 21.

FIG. 7 is a detailing of 13, the zinc plated aluminum bracket which holds bar 9, 10 in vertical storage position The mounting orifices for 13 are 24.

FIG. 8 is a top view of 13 reflecting depth of bracket. Bracket 13 is mounted to molding 18 with two screws 25.

This invention is adapted to do its intended function of preventing undesired forcible entry through the door to which it is affixed.

What is claimed is:

1. I claim that the original door bar is a security bar system with door-spanning telescoping tubes one end of which is headed and rests in one holder, and is capable of pivoting to a vertical position so the head may be lifted and nested, by its head structure, in a third holder located on the frame above the second holder.

* * * * *